United States Patent [19]

Wilson

[11] Patent Number: 4,609,390

[45] Date of Patent: Sep. 2, 1986

[54] PROCESS AND APPARATUS FOR SEPARATING HYDROCARBON GAS INTO A RESIDUE GAS FRACTION AND A PRODUCT FRACTION

[76] Inventor: Richard A. Wilson, P.O. Box 5987, Norman, Okla. 73070

[21] Appl. No.: 609,641

[22] Filed: May 14, 1984

[51] Int. Cl.[4] ..... F25J 3/06

[52] U.S. Cl. ..... 62/21; 62/23; 62/37; 62/39; 62/43

[58] Field of Search ..... 62/9, 11, 17, 20, 21, 62/23, 36, 37, 38, 39, 42, 43; 55/23, 25, 27

[56] References Cited

U.S. PATENT DOCUMENTS

| | | | |
|---|---|---|---|
| 2,315,424 | 7/1941 | Hill et al. | 62/11 |
| 4,128,409 | 12/1978 | Bennett | 62/39 |
| 4,141,707 | 2/1979 | Springmann | 62/9 |
| 4,410,342 | 10/1983 | Horton | 62/23 |

*Primary Examiner*—S. Leon Bashore
*Assistant Examiner*—Andrew J. Anderson
*Attorney, Agent, or Firm*—Laney, Dougherty, Hessin, Claro & Beavers

[57] ABSTRACT

A process and apparatus for separating a hydrocarbon feed gas into residue gas and a less volatile product fraction utilizing phase separation resulting from cooling. The present invention utilizes a portion of the liquid product fraction as internal refrigerant by expansion-cooling of the fraction which is then recycled after heat exchange to the inlet feed gas. No external refrigeration system is required. Flow of the portion of the liquid product fraction used as internal refrigerant is controlled with a Joule-Thompson valve responsive to the temperature of the residue gas and product fraction as they are separated so as to regulate expansion-cooling to provide a desired composition of the residue gas and the product fraction.

8 Claims, 2 Drawing Figures

PROCESS AND APPARATUS FOR SEPARATING HYDROCARBON GAS INTO A RESIDUE GAS FRACTION AND A PRODUCT FRACTION

BACKGROUND OF THE INVENTION

1. Field of the Invention

This invention relates, in general, to processes and apparatus for separating hydrocarbon gases into residue gases and less volatile products. More particularly, but not by way of limitation, the invention relates to processes and apparatus for separating gas streams such as natural gas streams into a residue gas fraction containing a major portion of methane and a product fraction containing a major portion of less volatile components.

2. Description of the Prior Art

In the utilization and marketing of natural gas and synthetic gas obtained from coal, oil and tar, it is desirable to separate ethane, propane and less volatile components from methane since the separated ethane, propane and less volatile components are substantially more valuable in their separated state. Processes for separating these components from natural gas are well known. Available processes for separating these materials include refrigeration processes, oil absorption processes, refrigerated oil absorption processes and cryogenic processes. The particular process chosen depends on factors such as plant location, equipment costs, composition of the residue gas and product fractions created, the availability of external energy sources, and other factors.

In a typical refrigeration system of separating a resiude gas from a product fraction, a natural gas feed at pipeline pressure and temperature is first compressed and then refrigerated. Refrigeration is generally accomplished by a closed loop freon or propane system and compressor. Following refrigeration to a phase-separating temperature and pressure, the natural gas is separated into a residue gas and a product liquid. For thermal efficiency, the feed gas moving between the compressor and the refrigerator is pre-cooled by heat exchange with the separated residue gas and product liquid.

The refrigeration processes and other processes for separating natural gas into residue gas fractions and less volatile fractions have not been entirely satisfactory. Particularly, the refrigeration capacity must be designed on the basis of the hottest weather in summer and the highest feed gas temperatures. This often results in an overly expensive refrigeration system and unnecessary refrigeration capacity during the vast majority of the operation time.

Another problem is that the refrigeration equipment or the equipment used in non-refrigeration processes is unnecessarily complicated and expensive to construct or repair. Similarly, such equipment is generally difficult to maintain, especially in remote locations. It is also not capable of adapting to a wide range of operating conditions and must be designed carefully for the appropriate temperatures and flow rates.

SUMMARY OF THE INVENTION

It is accordingly an object of the present invention to provide a process and apparatus for separating feed gas into a volatile residue gas fraction and a relatively less volatile product fraction which is improved over the processes and apparatus of the prior art.

Another object of the present invention is to provide a separation process and apparatus for performing a refrigeration-type separation not requiring an external refrigerator.

Yet another object of the present invention is to provide a separation process and apparatus having a simpler design and greater operating flexibility.

In accordance with these objects the process of the present invention separates a feed gas containing methane, ethane and less volatile components into a volatile residue gas fraction containing a major portion of methane and a relatively less volatile product fraction containing a major portion of ethane and less volatile components. The process comprises forming a first stream containing methane, ethane and less volatile components and then compressing this first stream. The compressed first stream is cooled to a phase separating temperature and pressure. The first stream is then phase separated to form a residue gas fraction containing a major portion of methane and a liquid fraction. A first portion of the liquid fraction is expanded to form an expansion-cooled second stream. Heat is exchanged between the expansion-cooled second stream and the first stream to achieve at least a portion of the cooling of the compressed first stream. At least a portion of the second stream is then recycled to the first stream upstream of the compressing step. A second portion of the liquid fraction is removed as a relatively less volatile product fraction containing a major portion of ethane and less volatile components.

As can be seen, the present invention achieves a refrigeration-type separation by utilizing a portion of the separated liquid fraction as an internal refrigerant and no external refrigeration is required. The expansion-cooled portion is recycled to the feed gas to be recompressed and reseparated. Preferably, the portion of the liquid fraction utilized as an internal refrigerant is controlled to provide the desired composition of the residue gas and of the product fraction. Also preferably, the expansion of the liquid fraction for expansioncooling is through a Joule-Thompson valve responsive to the temperature of the residue gas fraction and product fraction as they are phase separated.

A preferred method of cooling the first stream comprises separating the compressed first stream to form first, second and third substreams. A residue gas stream formed from the residue gas fraction exchanges heat with the first substream to cool the first substream. The second substream is cooled by heat exchange with the expansion-cooled second stream. The third substream is cooled by heat exchange with a product fraction stream formed from the product fraction. The first, second and third substreams, after heat exchange, are combined to form a combined first stream and the combined first stream exchanges heat with the expansion-cooled second stream for final cooling to a phase separation temperature. Essentially all cooling of the compressed feed gas to a phase separating temperature is achieved by these heat exchanger steps.

The apparatus of the present invention comprises a compressor for compressing feed gas and having an inlet through which feed gas enters the compressor and an outlet from which compressed gas leaves the compressor. A first heat exchanger is connected to the outlet of the compressor for cooling compressed gas to a phase separating temperature and pressure. A phase separator is connected to the first heat exchanger for separating cooled and compressed gas from the compressor and the first heat exchanger into a liquid fraction and a residue gas fraction. A Joule-Thompson valve is connected to receive a portion of liquid from the phase separator for expansion cooling thereof. A first conduit means connects the Joule-Thompson valve to the first heat exchanger for conveying expansion cooled fluid from the Joule-Thompson valve to the heat exchanger for heat exchange with compressed gas from the compressor. A second conduit means connects the first heat exchanger to the inlet of the compressor for conveying expansion-cooled fluid which has exchanged heat with compressed gas from the compressor back to the compressor for compression.

For a further understanding of the invention and further objects, features and advantages thereof, reference may now be had to the following description of preferred embodiments taken in conjunction with the accompanying drawings.

DESCRIPTION OF PREFERRED EMBODIMENTS

Figure 1:
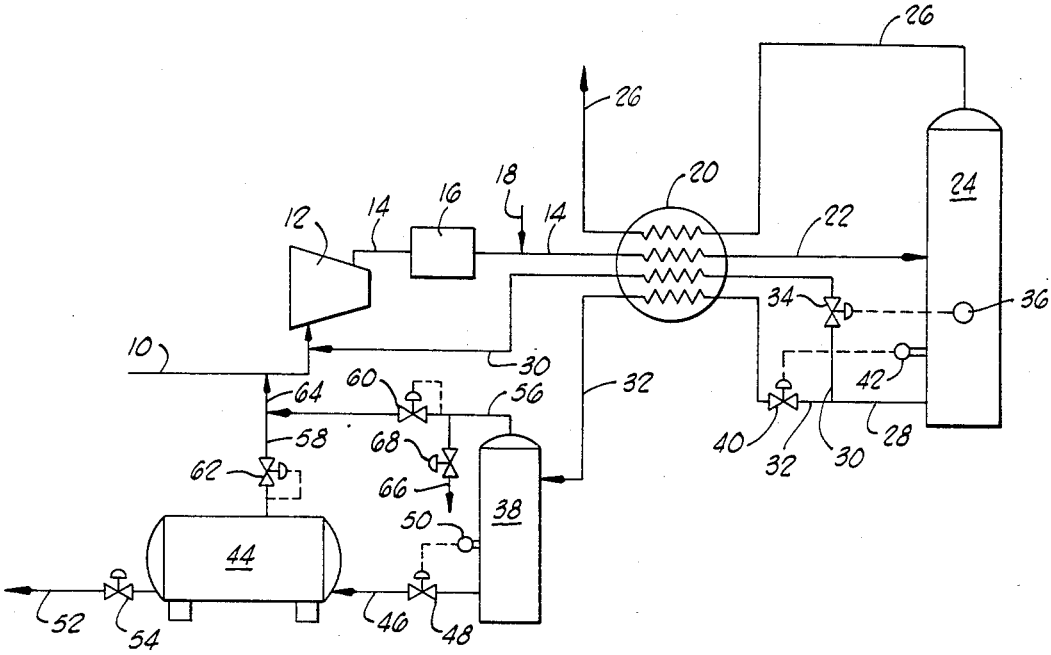
FIG. 1 is a flow diagram of a separation process and apparatus in accordance with the present invention.

Referring now to FIG. 1, an example of a process and apparatus performed and constructed in accordance with the present invention is shown in a schematic flow diagram. Gas, such as natural gas, is introduced to the system through an inlet gas feed stream 10. Typically, the feed gas 10 will be from a natural gas pipeline or directly from a well if the system is located at the well site. In such situations the feed gas will typically be natural gas at a pressure of from 10 to 50 psig and will include various amounts of water vapor and perhaps other contaminants.

The feed gas stream 10 is conveyed to the inlet of a compressor 12 where it is compressed in preparation for phase separation. A compressed feed gas stream 14 exits the outlet of compressor 12. The compressed gas stream 14 typically has a pressure of 700 psig and a temperature of 100° F. However, depending upon varying design conditions this stream may vary from 300 to 1200 psig and from 80° to 130° F.

Although not required by the present invention, in some instances it is desirable to include a dehydrator 16 for stream 14. The dehydrator 16 removes water from the compressed gas and helps prevent ice formation from occurring as the compressed gas is cooled. In addition, a hydrate inhibitor can be added to the compressed feed gas stream 14 through an inhibitor inlet stream 18. This further reduces the tendency for ice to form as the gas is cooled. Of course, the more effectively the dehydrator 16 operates, the less hydrate inhibitor must be added in the inhibitor stream 18.

Although not shown other treating devices for removing or treating contaminants can be added to the system as they would be preset on a conventional refrigeration-type separator.

Following dehydration and the addition of hydrate inhibitor, the compressed feed gas stream 14 is conveyed through a heat exchanger 20 for cooling the gas to a desired phase separation temperature. A cooled and compressed feed stream 22 exits heat exchanger 20 and enters a phase separator 24. The gas and liquid in stream 22 and phase separator 24 typically have a temperature of −20° F. and a pressure of 700 psig. However, depending upon design conditions, the temperature may vary from 0° F. to −50° F. and the pressure may vary from 300 to 1200 psig. Of course, the temperature and pressure of the gas and liquid in phase separator 24 controls the relative proportions of liquid and gas and the composition of the residue gas fraction and product fraction.

The phase separator 24 separates the cooled and compressed feed gas into a residue gas stream 26 and a relatively less volatile liquid product stream 28. The residue gas stream 26 comprises a major portion of methane and, as stated above, typically has a temperature of −20° F. and a pressure of 700 psig. The residue gas stream 26 is conveyed back through heat exchanger 20 for heat exchange with the incoming compressed feed gas stream 14. Following heat exchange in heat exchanger 20, the residue gas stream 26 is conveyed to a natural gas pipeline where the residue gas is typically sold to an ultimate user. As the residue gas stream leaves the heat exchanger 20 it would typically have a temperature of 90° F. and a pressure of 700 psig.

The liquid product stream 28 which exits the phase separator 24 generally comprises a major portion of ethane and less volatile components. The liquid fraction stream 28 is separated into a cooling stream 30 and a product stream 32. The cooling stream 30 is expanded through a Joule-Thompson valve 34 producing an expansion-cooling. Following expansion-cooling the cooling stream 30 then exchanges heat with the compressed feed gas stream 14 in heat exchanger 20. After exchanging heat the cooling stream 30 is conveyed back to the inlet gas stream 10.

After expansion-cooling through the Joule-Thompson valve 34 the cooling stream 30 typically has a temperature of −48° F. and a pressure of 50 psig. Following heat exchange in heat exchanger 20, the cooling stream is warmed to 60° F., still having a pressure of approximately 50 psig. Of course, flow rate, pressure drop and inlet temperature to the Joule-Thompson valve 34 can significantly affect the temperature and pressure of the cooling stream 30 as it is exchanging heat in heat exchanger 20.

The Joule-Thompson valve 34 is preferably responsive to a temperature control 36 monitoring the temperature of the liquid and/or gas in phase-separator 24 and adjusting the valve 34 accordingly. In this manner the flow rate of the cooling stream 30 is adjusted to regulate the temperature in phase-separator 24 or to maintain a predetermined temperature in separator 24. Of course, this temperature controls the composition of the residue gas in residue gas stream 26 and the composition of the liquid fraction in the liquid fraction stream 28.

The product stream 32 is conveyed to heat exchanger 20 for heat exchange with the compressed feed gas stream 14 and then to a product flash drum 38. Controlling the flow of product through the product stream 32 is a flow control valve 40 which is responsive to a liquid level controller 42. The liquid level controller 42 monitors the liquid level in phase-separator 24 and maintains the liquid level in the separator 24 by opening or closing the product flow valve 40. The temperature controller 36 should override the level controller 42 except that some liquid must be maintained in the phase separator 24.

As indicated above, the product in stream 32 enters the heat exchanger at approximately −20° F. and 700 psig. The stream 32 leaves heat exchanger 20 and enters the product flash tank 38 at approximately 80° F. and 400 psig. Liquid product from the product flash tank 38 is conveyed to a storage tank 44 by a storage stream 46. The flow through stream 46 is regulated by a storage stream flow valve 48 which is responsive to a liquid level control 50 on product flash tank 38. Thus, the liquid level in the product flash tank 38 is maintained by the flow rate through the storage stream 46. In addition to proudct flashing, other types of product stabilization, well known in the art, are capable of being used with the system of the present invention.

The product, comprised of a major portion of ethane and less volatile components, can be transferred from the storage tank 44 by truck or by pipeline to a desired location. A product delivery stream 52 regulated by a valve 54 transfers the stored product to a transport truck or pipeline. The storage tank 44 will typically have a content condition of ambient temperature and 250 psig.

To allow venting of gas which accumulates in the product flash tank 38 and the storage tank 44, streams 56 and 58 are provided. Valves 60 and 62 are disposed on the streams 56 and 58, respectively, to control the flow therein. The streams 56 and 58 join to form a single stream 64 which is connected to stream 10 allowing the vented gas to be recycled back to the compressor 12.

In some instances it is desirable to allow some of the gas produced in the product flash tank 38 to be produced as residue gas. A stream 66 and a valve 68 are connected to stream 56 upstream of valve 60 to allow residue gas to be produced from the product flash tank 38.

As described above, the apparatus of the present invention includes a heat exchanger 20 for exchaning heat between a relatively hot compressed gas steam and three relatively cold steams. A double pipe hairpin-type shell and tube exchanger is suitable for such heat exchange but it may be desirable to provide a simpler heat exchanger design by replacing the heat exchanger 20 with multiple, simple design heat exchangers.

Figure 2:
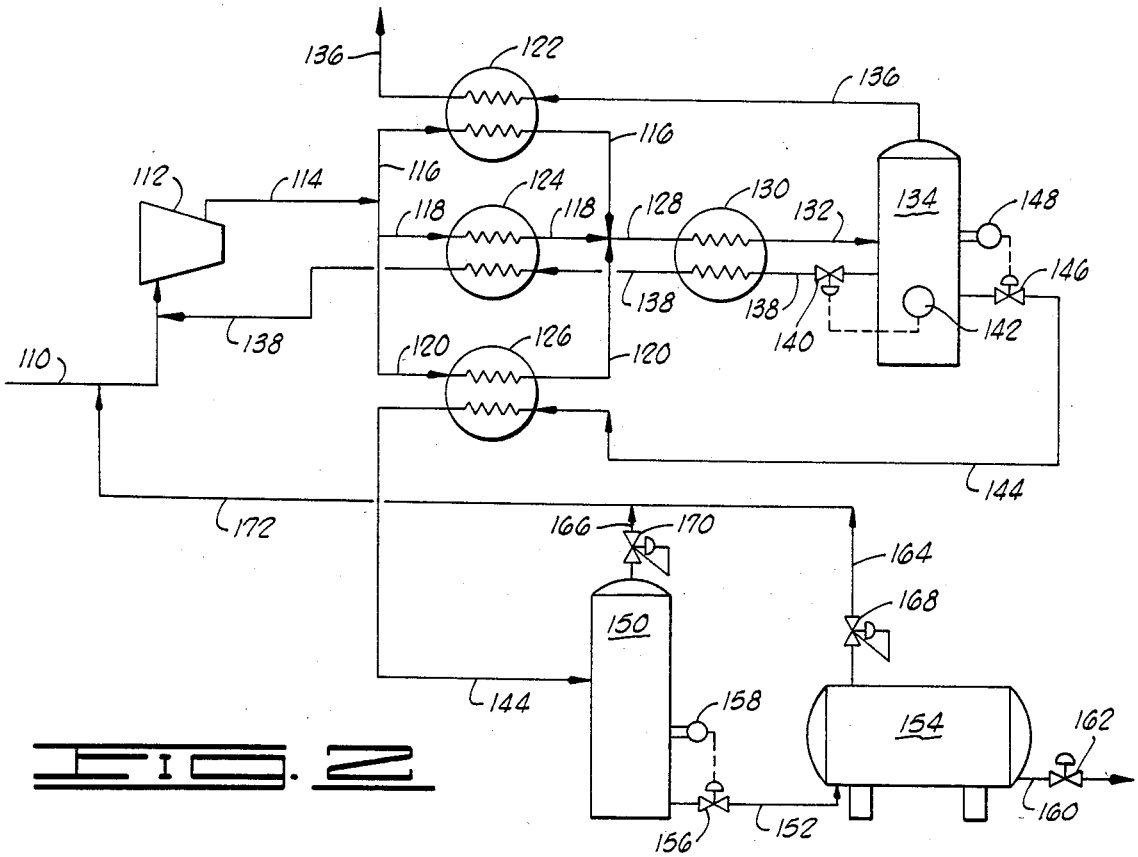
FIG. 2 is a flow diagram of an alternate embodiment separation process and apparatus in accordance with the present invention.

Referring now to FIG. 2, an alternate embodiment of the process and apparatus of the present invention is shown in a schematic flow diagram. A feed gas stream 110 is connected to the inlet of a compressor 112. This inlet gas is compressed in the compressor 112 and exits the compressor 112 in an outlet stream 114.

The outlet stream 114 is separated into first, second and third substreams 116, 118 and 120. These substreams, 116, 118 and 120 exchange heat in heat exchangers 122, 124 and 126, respectively.

Although not shown it is desirable to size the conduits carrying the substreams or have valves regulating the flow in the substreams so that each substream is cooled to approximately the same temperature.

Following cooling through the heat exchangers 122, 124 and 126 the substreams 116, 118 and 120 are combined to form a combined, cooled and compressed stream 128. The combined stream 128 is then finally cooled in a heat exchanger 130. Following the final cooling in heat exchanger 130, the feed gas is conveyed in a stream 132 to a phase-separator 134.

Residue gas is separated from the feed gas in the phase-separator 134 and forms a stream 136. The residue gas stream 136 exchanges heat with the substream 116 in heat exchanger 122 and then is conveyed to a residue gas pipeline or other external system.

A portion of the liquid reaction in phase separator 134 is used as a coolant by forming a stream 138 which is expanded through a Joule-Thompson valve 140 for expansion-cooling thereof. The expansion-cooled stream 138 is then used for final cooling of the combined stream 128 in heat exchanger 130 and then initial cooling of substream 118 in heat exchanger 124. The expansion-cooled stream, following heat exchange, is then recycled to the inlet gas stream 110 for recompression through compressor 112.

As with the first described embodiment, the Joule-Thompson valve 140 is controlled by and responsive to a temperature controller 142 disposed on the phase-separator 134. In this manner, the temperature of the product liquid and residue gas in phase-separator 134 is controlled by the flow and condition of the stream 138.

A second portion of the liquid fraction is phase separator 134 is conveyed from the separator in a product stream 144. The flow rate in the product stream 144 is controlled by a valve 146 responsive to a level controller 148 on phase separator 134. In this manner, the level of liquid in phase separator 134 is maintained by the flow rate of the product stream 144.

The product stream 144 exchanges heat with the substream 120 in heat exchanger 126 and then is conveyed to a product flash tank 150. A liquid stream 152 allows liquid product from the product flash tank 150 to be conveyed to a product storage tank 154. A valve 156 responsive to a level controller 158 on product flash tank 150 controls the flow through stream 152. The level in product flash tank 150 is thus controlled by the flow rate of stream 152. The product stored in storage tank 154 can be conveyed to a transport truck or pipeline through stream 160 and the flow through stream 160 is controlled by a valve 162.

Gas can be vented from the product flash tank 150 and the storage tank 154 by means of streams 166 and 164, respectively. The valves 168 and 170 control the flow through the streams 164 and 166 responsive to the pressures in the tanks 150 and 154. The streams 164 and 166 are combined to form a stream 172 for recycle to the inlet gas stream 170 and recompression in the system.

The processes and apparatus of the present invention have been described in terms of streams of fluids. It is, of course, understood that the apparatus of the present invention is constructed of conduits for conveying the streams from each piece of equipment to the next. Also, the processes of the present invention can be continuously operated so that the streams described have essentially steady flow rates. However, some streams such as the gas streams 64 and 172 and the product streams 52 and 160 may be intermittent even while the remaining streams are operating at steady flow rates.

EXAMPLE I

To allow comparison with the process and apparatus of the present invention, Table I below illustrates a system utilizing a flow as in the flow diagram illustrated in FIG. 2 and described above except that no cooling stream 138 is provided. It is required for this example that an external refrigeration system be disposed for cooling where heat exchanger 130 connects streams 128 and 132. Stream 110 has a pressure of 50 psig. and a temperature of 60° F. Stream 114 has a pressure of 700 psig. and a temperature of 100° F. Following cooling in exchangers 122 and 126 and then in an external refrigerator replacing exchanger 130, stream 132 has a temperature of −20° F. and a pressure of 700 psig. After heat exchange stream 136 has a temperature of 90° F. and stream 144 has a temperature of 80° F.

Flows calculated for a process operating according to the above descriptions are set forth in Table I. The hydrocarbon components referred to in Table I (and in Table II) are in shorthand so that $C_1$ refers to methane, $C_2$ refers to ethane, etc. MCF/D refers to thousand cubic feet per day, MOL % refers to mole percent and GAL/D refers to gallons per day.

TABLE I

| | Inlet Gas Stream 110 | | Residue Stream 136 | Product Stream 160 | | Recycle Streams 166 | 164 | Total |
|---|---|---|---|---|---|---|---|---|
| | MCF/D | MOL % | MCF/D | MCF/D | GAL/D | MCF/D | MCF/D | MCF/D |
| $N_2$ | 37.59 | 9.40 | 37.58 | .00 | — | 1.48 | .08 | 1.56 |
| $CO_2$ | .97 | .24 | .92 | .05 | — | .24 | .08 | .32 |
| $C_1$ | 250.96 | 62.73 | 249.25 | 27.71 | — | 27.82 | 5.51 | 33.33 |
| $C_2$ | 35.13 | 8.78 | 25.37 | 9.65 | 245.09 | 13.02 | 6.92 | 19.94 |
| $C_3$ | 37.58 | 9.40 | 9.87 | 27.65 | 758.27 | 8.89 | 6.69 | 15.58 |
| $iC_4$ | 5.33 | 1.33 | .53 | 4.79 | 156.10 | .61 | .50 | 1.11 |
| $nC_4$ | 17.79 | 4.45 | 1.19 | 16.59 | 520.88 | 1.55 | 1.28 | 2.83 |
| $iC_5$ | 3.31 | .83 | .08 | 3.23 | 117.51 | .13 | .12 | .25 |
| $nC_5$ | 6.02 | 1.51 | .10 | 5.91 | 212.84 | .18 | .17 | .35 |
| $C_6$+ | 5.32 | 1.33 | .00 | 5.31 | 270.81 | .00 | .00 | .00 |
| TOT | 400.00 | 100.00 | 324.90 | 74.84 | 2309.21 | 53.93 | 21.36 | 75.29 |

EXAMPLE II

A process in accordance with the process and apparatus of the present invention is illustrated in Table II below. The conditions in the streams are precisely the same as in Example I except that refrigeration is provided by expansion-cooling through stream 138 and no external refrigeration is utilized. The proportional flow rates in substreams 116, 118 and 120 are regulated to provide a temperature of 10° F. in each of the substreams as they are combined to form stream 128. Stream 136 has a temperature of 90° F. and stream 144 has a temperature of 80° F. Downstream of the Joule-Thompson valve 140 stream 138 has a temperature of −48° F. and a pressure of 50 psig. Downstream of heat exchanger 130 stream 138 has a temperature of 5° F. and downstream of heat exchanger 124, stream 138 has a temperature of 60° F. The product and residue gas temperatures and pressures are the same as in Example I.

TABLE II

| | Inlet Gas Stream 110 | | Residue Stream 136 | Product Stream 160 | | Recycle Streams 138 | 166 | 164 | Total |
|---|---|---|---|---|---|---|---|---|---|
| | MCF/D | MOL % | MCF/D | MCF/D | GAL/D | MCF/D | MCF/D | MCF/D | MCF/D |
| $N_2$ | 37.59 | 9.40 | 37.58 | .01 | — | 1.11 | 1.48 | .07 | 2.66 |
| $CO_2$ | .97 | .24 | .91 | .05 | — | .26 | .23 | .08 | .57 |
| $C_1$ | 250.96 | 62.73 | 249.13 | 1.66 | 28.05 | 24.68 | 27.58 | 5.49 | 57.75 |
| $C_2$ | 35.13 | 8.78 | 25.06 | 9.58 | 243.31 | 20.52 | 12.71 | 6.75 | 39.98 |
| $C_3$ | 37.58 | 9.40 | 9.82 | 27.46 | 753.06 | 29.68 | 8.73 | 6.54 | 44.95 |
| $iC_4$ | 5.33 | 1.33 | .54 | 4.81 | 156.75 | 3.96 | .61 | .49 | 5.06 |
| $nC_4$ | 17.79 | 4.45 | 1.20 | 16.66 | 523.07 | 12.76 | 1.54 | 1.27 | 15.57 |
| $iC_5$ | 3.31 | .83 | .08 | 3.23 | 117.51 | 2.06 | .13 | .12 | 2.31 |
| $nC_5$ | 6.02 | 1.51 | .11 | 5.91 | 212.84 | 3.53 | .19 | .17 | 3.89 |
| $C_6$+ | 5.32 | 1.33 | .01 | 5.31 | 270.81 | 1.06 | .02 | .02 | 1.10 |
| TOT | 400.00 | 100.00 | 324.43 | 74.78 | 2305.40 | 99.62 | 21.36 | 21.00 | 173.84 |

It can be seen that the internal refrigeration recycle of the present invention produces essentially the same product fraction and residue fraction composition as an external refrigeration system. Unlike the external refrigeration system, however, the present invention allows great operating flexibility by variation of the recycle rate. It simplifies the equipment and maintenance and does not significantly increase energy use. Only one compressor is required since the external refrigeration cycle compressor is eliminated. Under conditions where a conventional refrigeration system would be operating inefficiently, due to conditions varying from the design conditions, the present system is more efficient. Finally, by varying the recycle rate the relative proportions and composition of residue gas fraction and product fraction can be easily changed.

The single compressor of the present invention provides both cooling and compression of the feed gas. This allows optimum allocation of the power to the system by allowing more gas to be processed at a lower temperature if the compressor is not loaded or more recycle and lower temperature if the gas feed volume is low. Of course, the single compressor lowers the cost of the system compared to convention refrigeration systems and eliminates the necessity of freon make-up and other maintenance.

Thus, the process and apparatus of the present invention are well adapted to achieve the objects and advantages mentioned as well as those inherent therein. While presently preferred embodiments of the present invention have been described for the purpose of this disclosure, numerous changes in the details of the process steps and the construction and arrangement of parts of the apparatus can be made by those skilled in the art, which changes are encompassed within the spirit of this invention as defined by the appended claims.

The foregoing disclosure and the showings made in the drawings are merely illustrative of the principals of the invention and are not to be interpreted in a limiting sense.

What I claim is:

1. A process for the separation of a feed gas containing methane, ethane and less volatile components into a volatile residue gas fraction containing a major portion of methane and a relatively less volatile product fraction containing a major portion of ethane and less volatile components, comprising:

forming a first stream containing methane, ethane and less volatile components;

compressing said first stream;

cooling said compressed first stream to a phase separating temperature and pressure;

phase separating said cooled first stream into a residue gas fraction containing a major portion of methane and a liquid fraction;

expanding a first portion of said liquid fraction through a Joule-Thompson valve to form an expansion-cooled second stream;

exchanging heat between said second stream and said first stream achieving at least a portion of said cooling said compressed first stream;

recycling at least a portion of said second stream into said first stream upstream of said compressing step;

removing a second portion of said liquid fraction as a relatively less volatile product fraction containing a major portion of ethane and less volatile components; and controlling flow through said Joule-Thompson valve responsive to the temperature of the residue gas fraction and product fraction as they are phase separated so as to regulate expansion-cooling to provide a desired composition of said residue gas and said product fraction.

2. The process of claim 1 wherein said cooling of said compressed first stream to a phase separating temperature is performed by heat exchange steps consisting essentially of:

said step of exchanging heat between said second stream and said compressed first stream;

exchanging heat between said residue gas fraction and said compressed first stream; and exchanging heat between said product fraction and said compressed first stream.

3. The process of claim 1 which further comprises:

separating said compressed first stream to form first, second and third substreams;

forming a residue gas stream from said residue gas fraction and exchanging heat between said residue gas stream and said first substream;

exchanging heat between said expansion-cooled second stream and said second substream;

forming a product fraction stream from said product fraction and exchanging heat between said product fraction stream and said third substream;

combining, downstream of said heat exchange, said first, second and third substreams to form a combined first stream; and exchanging heat between said combined first stream and said expansion-cooled second stream.

4. An improved process for the continuous separation of a hydrocarbon feed gas into a volatile residue gas and a relatively less volatile fraction of the type wherein the hydrocarbon feed gas is compressed, cooled to a liquid fraction and a residue gas fraction, and the liquid fraction is separated from the residue gas fraction, the improvement comprising:

performing at least a portion of said cooling by expansion cooling of a portion of said liquid fraction through a Joule-Thompson valve and exchanging heat between said expansion-cooled portion and said compressed feed gas;

recycling said expansion-cooled portion to form a portion of said feed gas prior to compression; and controlling said step of expansion-cooling of a portion of said liquid fraction by regulating the flow through said Joule-Thompson valve responsive to the temperature of the residue gas fraction and liquid fraction as they are separated so as to provide a desired composition of said residue gas and said liquid fraction.

5. The process of claim 4 wherein said cooling of said compressed hydrocarbon feed gas is performed by heat exchange steps consisting essentially of:

said step of exchanging heat between said expansion-cooled portion and said compressed feed gas;

exchanging heat between said residue gas fraction and said compressed feed gas; and exchanging heat between said product fraction and said compressed feed gas.

6. The process of claim 4 which further comprises:

separating said compressed feed gas to form first, second and third subportions of said feed gas;

exchanging heat between said residue gas and said first subportion;

exchanging heat between said expansion-cooled portion and said second subportion; exchanging heat between said product fraction and said third subportion, combining, said first, second and third subportions to form a combined feed gas; and exchanging heat between said combined feed gas and said expansion-cooled portion.

7. An apparatus for separating a feed gas containing methane, ethane and less volatile components into a volatile residue gas fraction containing a major portion of methane and a relatively less volatile fraction containing a major portion of ethane and less volatile components, comprising:

a compressor for compressing feed gas having an inlet through which feed gas enters said compressor and an outlet from which compressed gas exits said compressor;

a first heat exchanger connected to said outlet of said compressor for cooling compressed gas to a phase separating temperature and pressure;

a phase separator connected to said first heat exchanger for separating cooled and compressed gas from said compressor and said first heat exchanger into a liquid fraction and residue gas fraction;

a Joule-Thompson valve connected to receive a portion of liquid from said phase separator for expansion cooling thereof;

first conduit means connecting said Joule-Thompson valve to said first heat exchanger for conveying expansion-cooled fluid from said Joule-Thompson valve to said heat exchanger for heat exchange with compressed gas from said compressor;

second conduit means connecting said first heat exchanger to said inlet of said compressor for conveying expansion-cooled fluid which has exchanged heat with compressed gas from said compressor to said compressor for compression; and temperature control means for controlling the temperature of fluids in said phase separator, said Joule-Thompson valve being connected and responsive thereto to regulate expansion-cooling responsive to said temperature control means.

8. An apparatus for separating a feed gas containing methane, ethane and less volatile components into a volatile residue gas fraction containing a major portion of methane and a relatively less volatile fraction containing a major portion of ethane and less volatile components, comprising:

a compressor for compressing feed gas having an inlet through which feed gas enters said compressor and an outlet from which compressed gas exits said compressor;

first, second, and third heat exchangers connected to said outlet of said compressor for cooling compressed gas conveyed therethrough;

a fourth heat exchanger connected to said first, second and third heat exchangers for receiving cooled compressed gas therefrom fand for further cooling said coled, compressed gas to a phase separating temperature and pressure;

a phase separator connected to said first heat exchanger for separating cooled and compressed gas from said compressor and said heat exchangers into a liquid fraction and a residue gas fraction;

a Joule-Thompson valve connected to receive a first portion of liquid from said phase separator for expansion cooling thereof;

first conduit means connecting said Joule-Thompson valve to said fourth heat exchanger for conveying expansion-cooled fluid from said Joule-Thompson valve to said heat exchanger for heat exchange with compressed gas from said compressor;

second conduit means connecting said fourth heat exchanger to said second heat exchanger for conveying expansion-cooled fluid from said fourth heat exchanger to said second heat exchanger for heat exchange with compressed gas from said compressor;

third conduit means connecting said second heat exchanger to said inlet of said compressor for conveying expansion-cooled fluid which has exchanged heat with compressed gas from said compressor to said compressor for compression;

fourth conduit means connecting said phase separator to said first heat exchanger for conveying residue gas to said first heat exchanger for heat exchange with compressed gas from said compressor;

fifth conduit means connecting said phase separator to said third heat exchanger for conveying a second portion of liquid from said phase separator to said third heat exchanger for heat exchange with compressed gas from said compressor; and temperature control means for controlling the temperature of fluids in said phase separator, said Joule-Thompson valve being connected and responsive thereto to regulate expansion-cooling responsive to said temperature control means.

* * * * *